US006375390B1

(12) United States Patent
Lunardi

(10) Patent No.: US 6,375,390 B1
(45) Date of Patent: Apr. 23, 2002

(54) METHOD FOR WIDENING ROAD, SUPERHIGHWAY OR RAILWAY TUNNELS, WITHOUT INTERRUPTING THE TRAFFIC

(76) Inventor: Pietro Lunardi, Piazza San Marco,1, 20121, Milan (IT)

( * ) Notice: Subject to any disclaimer, the term of this patent is extended or adjusted under 35 U.S.C. 154(b) by 0 days.

(21) Appl. No.: 09/217,326

(22) Filed: Dec. 21, 1998

(51) Int. Cl.[7] ..... E21D 9/01; E21D 9/087

(52) U.S. Cl. ..... 405/146; 405/150.2; 405/151; 405/150.1; 405/134; 405/141; 405/138

(58) Field of Search ..... 405/138, 139, 405/140, 124, 146, 150.1, 151, 141, 145, 134, 148

(56) References Cited

U.S. PATENT DOCUMENTS

| | | | | | |
|---|---|---|---|---|---|
| 1,414,129 | A | * | 4/1922 | Hewett et al. | 405/151 |
| 2,077,137 | A | * | 4/1937 | Wilkoff | 405/151 |
| 3,413,811 | A | * | 12/1968 | Giacobino | 405/140 |
| 3,640,076 | A | * | 2/1972 | Rees et al. | 405/146 |
| 3,916,630 | A | * | 11/1975 | Arsuaga | 405/146 |
| 4,166,509 | A | * | 9/1979 | Ueno et al. | 405/139 |
| 4,423,981 | A | * | 1/1984 | Nilberg | 405/146 |
| 4,569,616 | A | * | 2/1986 | Takahashi et al. | 405/150 |
| 4,813,813 | A | * | 3/1989 | Yamamoto et al. | 405/146 |
| 4,895,480 | A | * | 1/1990 | Jackel et al. | 405/146 |
| 5,104,260 | A | * | 4/1992 | Trevisani | 405/138 |
| 5,152,638 | A | * | 10/1992 | Trevisani | 405/140 |
| 5,632,575 | A | * | 5/1997 | Lorenzen et al. | 405/184 |
| 5,645,375 | A | * | 7/1997 | Stephens | 405/146 |
| 6,129,484 | A | * | 10/2000 | Chiaves | 405/134 |

FOREIGN PATENT DOCUMENTS

| | | | | |
|---|---|---|---|---|
| DE | 1187659 | * | 2/1965 | 405/151 |
| DE | 2743225 | * | 9/1977 | E21D/11/12 |

* cited by examiner

*Primary Examiner*—Thomas B. Will
*Assistant Examiner*—Alexandra K Pechhold

(57) ABSTRACT

A construction method for widening road, superhighway or railway tunnels, without interrupting the traffic flow includes a first stage of excavation; in steps, of the ground between the theoretical profile of the future widened tunnel and that of the original tunnel, after having reinforced the ground between the theoretical profile of the future widened tunnel and that of the original tunnel by reinforcement operations on the face, and a second stage in which the final lining, comprising one or more arches of prefabricated segments is placed close to the face.

7 Claims, 4 Drawing Sheets

METHOD FOR WIDENING ROAD, SUPERHIGHWAY OR RAILWAY TUNNELS, WITHOUT INTERRUPTING THE TRAFFIC

BACKGROUND OF THE INVENTION

The present invention relates to construction method for widening road, superhighway or railway tunnels, without interrupting traffic flow.

Due to the continuously increasing traffic demands, it is frequently necessary to widen roads, superhighways or railways in order to improve their traffic handling capabilities.

Even if this problem can be solved in a comparatively easy manner, in the case of transport routes which run entirely on the surfaces, the solution of this problem is very complex and nearly impossible when the routes pass through tunnels.

In fact, widening a tunnel involves great problems mainly related to the discomfort and safety of the users, as well as technical and operating problems related to works to be performed in a ground already disturbed by a previous boring or excavation, in addition to problems related to the stress-strain conditions occurring as the widening operations are carried out.

SUMMARY OF THE INVENTION

Accordingly, the aim of the present invention is to solve the above mentioned problems, by providing a construction method that allows road, superhighway and railway tunnels to be widened without interrupting traffic flow.

Within the scope of the above mentioned aim, a main object of the present invention is to provide such a construction method which is very safe for the users, while reducing to a minimum the user inconvenience.

Another object of the present invention is to provide such a construction method which is very flexible in that it can be employed in any type of ground and stress-strain condition that occurs as said method is carried out.

Another object of the present invention is to provide such a construction method which guarantees the observance of work schedules specified in the design, independently of the type of ground and stress-strain conditions involved, while reducing and reliably planning construction costs and times, and also reducing to a minimum traffic deviations and consequent user inconvenience.

Another object of the present invention is to provide such a construction method specifically designed for solving the problem of the possible presence, around the original cavity, of a band of ground which has been already plasticized and which must not be further disturbed.

Yet another object of the present invention is to provide such a construction method that allows to cross section of a tunnel to be widened without causing any damaging deformation in the ground to be triggered, which would in turn cause very strong pressure on the lining of the final widened tunnel, and result in differential surface settlements very dangerous for surface constructions above.

According to one aspect of the present invention, the above mentioned aim and objects, as well as yet other objects, which will become more apparent hereinafter, are achieved by a construction method for widening road, superhighway or railway tunnels, without interrupting the traffic flow, which is characterized in that said construction method comprises:

- a first stage in which the ground between the theoretical profile of the future widened tunnel and that of the original tunnel is excavated in steps, and

- a second stage in which the final lining, consisting of one or more arches of prefabricated segments is placed in steps, close to the face, and prestressed in order to provide an immediate confinement pressure against the ground behind it.

BRIEF DESCRIPTION OF THE DRAWINGS

Further characteristics and advantages of the construction method according to the present invention will become more apparent hereinafter from an examination of the following description of a preferred, though not exclusive, form of implementation of said construction method, which is illustrated, by way of an indicative, but not limitative, example, in the attached drawings, where.

DESCRIPTION OF THE PREFERRED IMPLEMENTATION

Figure 1:
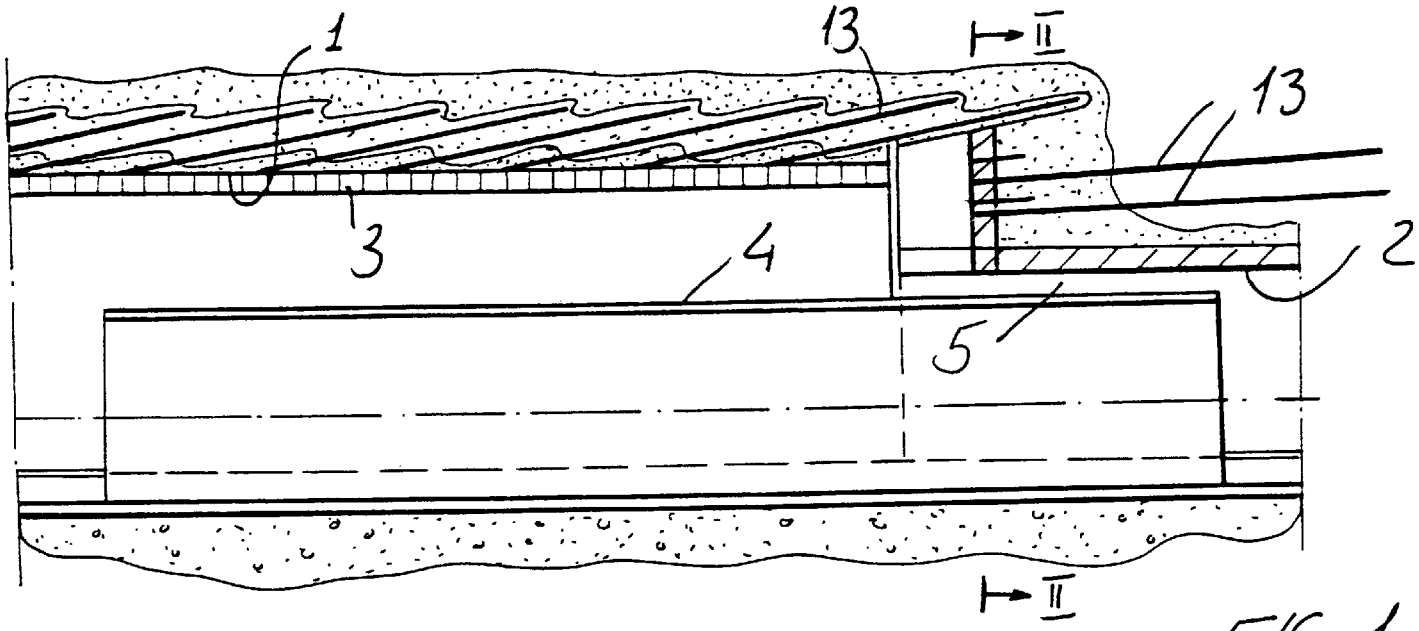
FIG. 1 is a schematic view illustrating the tunnel widening construction method according to the invention, showing a longitudinal profile of the tunnel through a center line vertical section.
Figure 2:
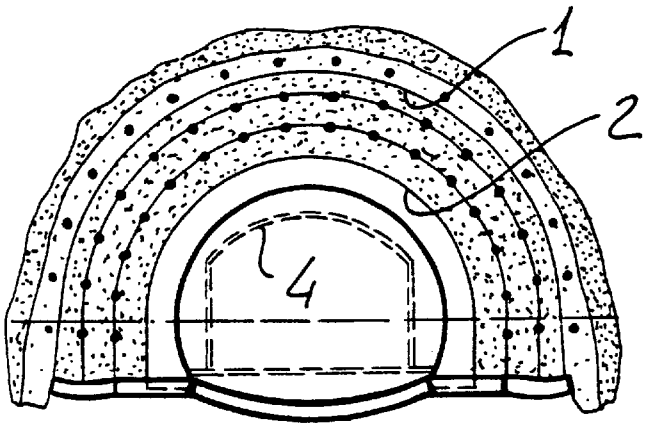
FIG. 2 is a cross-sectional view of FIG. 1, taken along the section line II—II.
Figure 3:
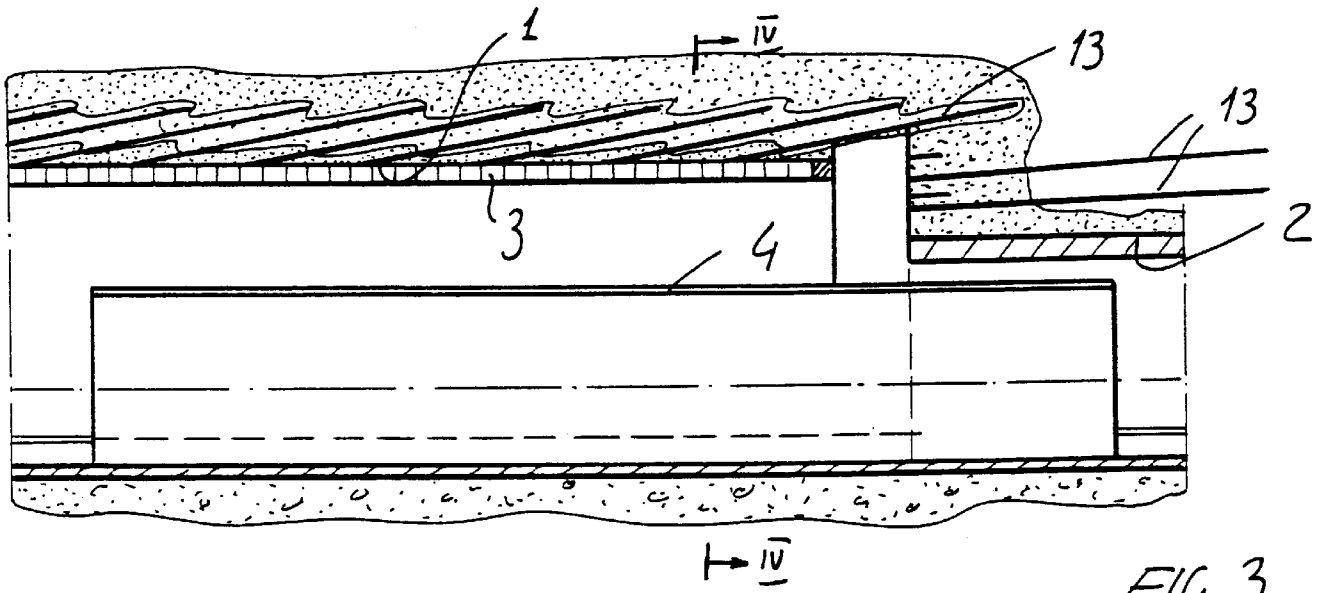
FIG. 3 is a schematic longitudinal profile view similar to that of FIG. 1 illustrating the segment placing stage, that alternates with the face excavation stage.
Figure 4:
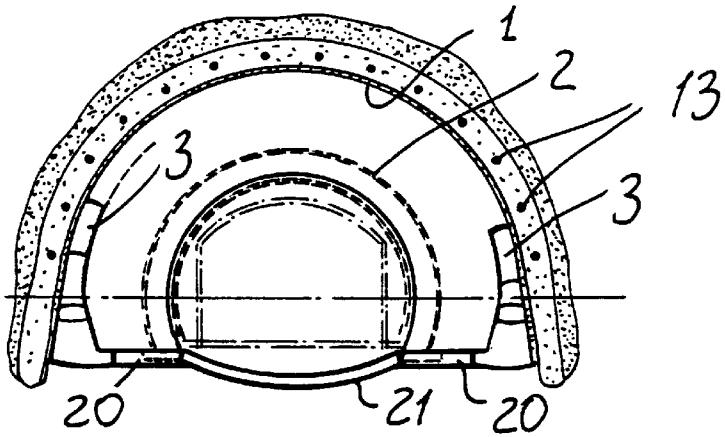
FIG. 4 is a cross-sectional view of FIG. 3 taken along the section line IV—IV.
Figure 5:
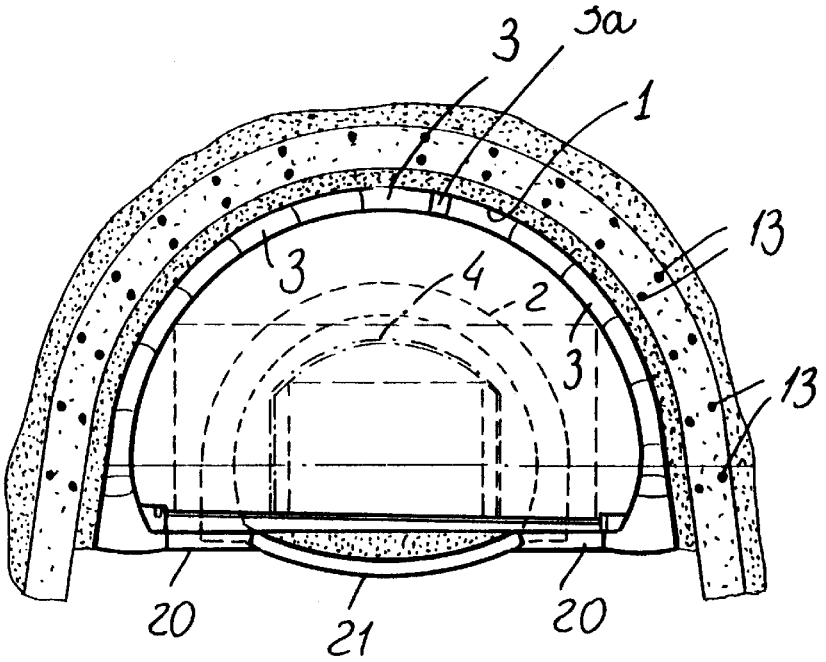
FIG. 5 schematically illustrates a cross-section of a tunnel being widened, in the case in which a structural joining piece joining the widened tunnel and the tunnel invert of the original tunnel is used.
Figure 6:
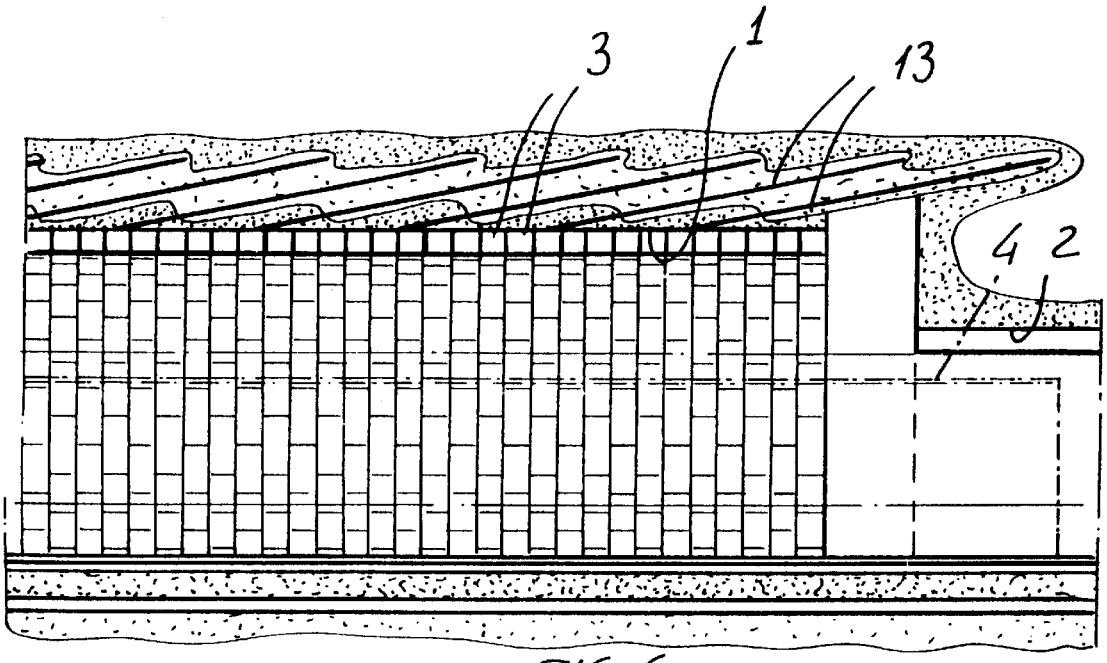
FIG. 6 is the longitudinal section of the tunnel in FIG. 5.
Figure 7:
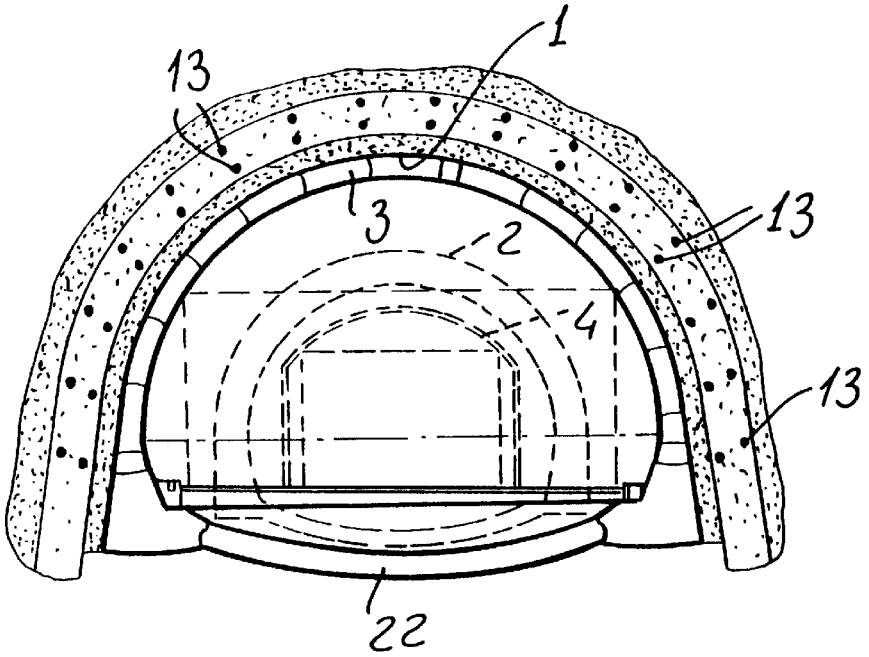
FIG. 7 is a schematic view illustrating a cross-section of a tunnel being widened, but placing a completely new tunnel invert.
Figure 8:
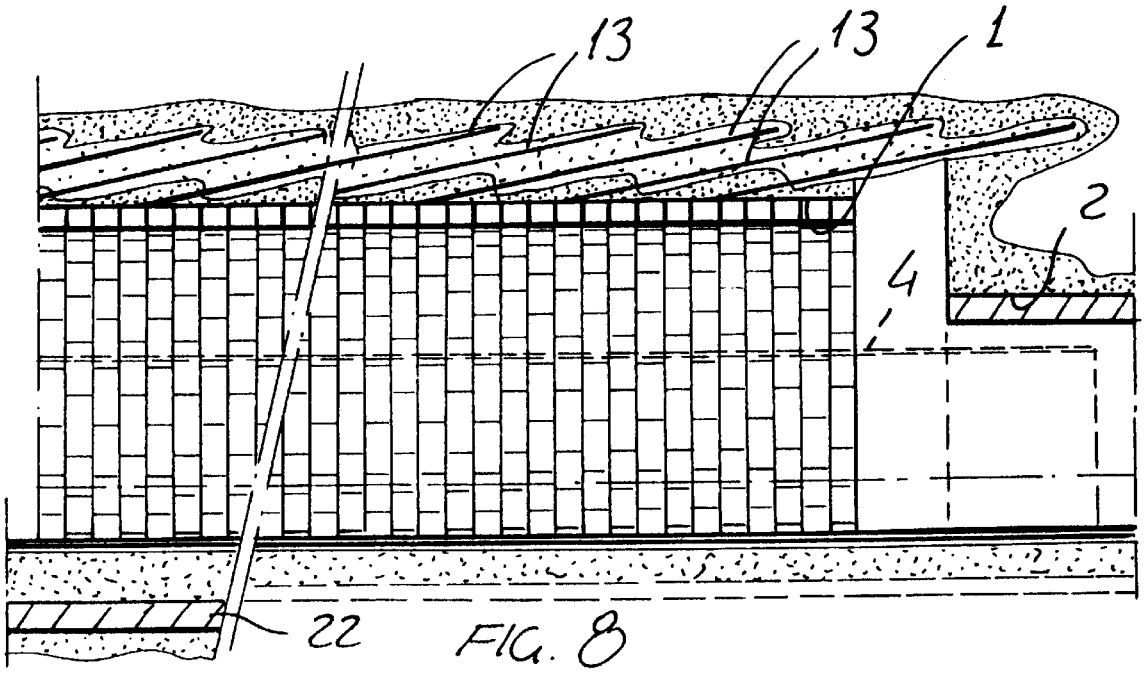
FIG. 8 is the longitudinal cross-section of the tunnel of FIG. 7.

With reference to the number references of the above mentioned figures, the construction method according to the present invention comprises substantially:

- a first stage, in which the ground between the theoretical profile of the future widened tunnel 1 and that the original tunnel 2 is excavated in steps (the size of which will depend on the characteristics of he ground involved;
- a second stage, in which the final lining, comprising one or more arches of prefabricated segments 3 is placed in tunnel advance steps (having a length appropriate to the tunnel advance performed in the preceding stage), very close to the face (i.e. at a maximum distance of 2–3 meters), and prestressed in order to provide an immediate confinement pressure against the ground behind it, and
- a third stage, in which an optional foundation construction is made (e.g. tunnel invert).

If necessary, before the first stage of the construction method is performed, it is possible to carry out a preparatory stage in which the ground between the theoretical profile of the future widened tunnel 1 and that of the original tunnel 2 is acted on, by performing reinforcement operations of the face and preconfinement of the final widened cavity, such as: horizontal "jet-grouting" or, alternatively, mechanical pre-cutting or reinforcement of the ground ahead of the face with valved and grout-injected fibre glass structural elements (e.g. tubes).

Depending on the length in advance of the preparatory stage, the subsequent excavation and lining stages (i.e. the first and second stages), can be carried out in alternation several times, thereby allowing the length in advance of subsequent preparatory stages to overlap sufficiently.

During the first two operating stages, a traffic protecting steel shell 4 is used inside the profile of the original tunnel, the machinery for the work being driven and operated above said steel shell.

The hollow space 5 between the traffic protecting steel shell 4 and the original tunnel lining 2 is filled with soundproofing and/or anti-shock material.

The steel shell 4, having a length corresponding to at least 4 times the diameter of the tunnel to be widened, will occupy a comparatively small space in said tunnel, thereby allowing the operating stages to be carried out without interrupting the vehicle traffic flow on the existing traffic lanes.

At the end of the second operating stage, the shell 4 will be caused to advance for the length of one tunnel advance, and the various operating stages will be cyclically repeated to provide the desired final widened tunnel.

All problems connected with the deformation response of the ground are solved by the adoption of reinforcement of the face and preconfinement of the cavity (in the case of a preparatory stage) and by excavation in steps with immediate placing of a final lining of prefabricated concrete segments (prestressed in order to provide an immediate confinement pressure against the ground behind it) in the first and second stages. These measures are crucial in that they halt all deformation phenomena at the onset even at a short distance from the face.

The various operating stages of the construction method will be described in a more detailed manner hereinbelow.

The preparatory stage of the method, as has been said, involves reinforcement of the face using fibre glass structural elements (e.g. tubes) 13 and/or, depending on the geological-geotechnical context, preconfinement operations on the cavity, such as: horizontal "jet grouting", mechanical precutting or reinforcement of the ground ahead of the face using valve grout-injected fibre glass structural elements (e.g. tubes) 13 around the cavity In the first stage of the construction method according to the invention, excavation to widen the tunnel is performed and the original tunnel is demolished.

These operations are carried out in short steps (from 60 to 150 cm) depending on the stress-strain conditions of the ground and the size of the prefabricated segments 3, used for the final lining (see the second operating stage).

If the situation allows, it is possible to advance in steps of length 2, 3 or more times that of the said prefabricated segments 3, and then place the appropriate number of arches of prefabricated segments.

The machinery for performing this excavation consists of one or more excavation cutters as well as heavy duty shearing devices for cutting the steel ribs and metal elements of the lining of the original tunnel to be demolished. This machinery operates completely above said traffic protecting steel shell 4.

In the second operating stage the final lining of the widened tunnel, consisting of arches of prefabricated segments 3, is placed.

The main operation are performed as follows:

A) transport of the segments 3 to the face, by special conveyor belts positioned on one side of the widened tunnel;

B) application of delayed setting epoxy resin on the two ends of each segment 3 to be placed and on the side of it that will come into contact with the arch of the lining that has already been erected;

C) raising and positioning of segments 3 by means of a segment placing machine, placing the lowermost segments on each side of the tunnel first and then placing the segments in ascending order until the arch is completed with the placing of the key segment 3*a;*

D) placing a mortar filling behind the prefabricated segment arch 3;

E) placing the jack in the key segment 3*a* under pressure to make the various segments adhere to each other perfectly and to immediately produce the necessary pre-stress effect to confine the ground around the widened tunnel.

Thus, it will be always possible, even at a later time, to increase the pressure by means of the key segment 3*a,* according to the behaviour of the ground.

In the third operating stage, a foundation structure, if necessary, is constructed placing a simple joining piece 20 between the lining of the new widened tunnel and the invert 21 of the original tunnel, or by casting a new tunnel invert 22.

During this third operating stage, in order not to interrupt the traffic through the tunnel, two cases must be distinguished:

in the case of a railway tunnel, after having widened this tunnel, train traffic must be in any case stopped in order to adapt the tracks to the new situation. In the meanwhile the joining piece joining the final lining of the new widened tunnel and the invert of the original tunnel is placed or (if the statics of the tunnel require it) a new tunnel invert is cast;

in the case of a single tube road tunnel then, by suitably organizing the operations for placing the foundation and widening the road, traffic glow can always be maintained on at least one lane in each direction. Similarly, for twin tunnel highways with at least two lanes in each direction, the traffic flow can always run on at least one or two lanes in each direction, by suitably switching work on the foundation and road widening operations from one to the other tube, and by switching the traffic flow, according to requirements, to the lanes as they are available.

From the above description and from an examination of the attached drawings, it can be seen that the invention fully achieves the intended aim and objects.

In particular, it should be pointed out that the construction method according to the invention allows all the problems involved in widening road, superhighway or railway tunnels to be solved, while allowing continuous traffic flow during the widening operations.

In particular, the construction method according to the invention, with the adoption if necessary of "cavity preconfinement" is able to limit or even eliminate deformation of the face and of the cavity and therefore also prevents uncontrolled loosening of the ground excavated, thereby providing very safe working conditions.

The placing of a final lining of prefabricated segment (prestressed in order to provide an immediate confinement pressure against the ground behind it), at reduced intervals and, therefore, very close to the face, means that it is unnecessary to perform stabilizing operations of passive nature such as the use of shotcrete and steel ribs.

The possibility, afforded by the construction method according to the invention, of pre-stressing the final lining using the key segment jack, allows the loads to be recentred, if bending moments in the arch change in such a way as to place part of the cross section of the arch under tensile stress.

The full mechanization of the operating stages of the construction method in question, with consequent regular tunnel advance, faster rates and construction times, are all factors that have positive repercussions on site costs and construction speeds.

Moreover, by performing all the widening operations while protecting the road with a steel shell, the traffic thereunder can continue to flow safely greatly reducing user discomfort.

Finally, the extreme flexibility of the construction method in question allows it to be employed in any ground, under any stress-strain conditions and in full safety.

Obviously, the construction method of the invention has been described and illustrated purely as an example for the sole purpose of demonstrating how it may be implemented in practice and of describing the general characteristics. It may of course be varied with all those modifications that an expert in the field might make without deviating from the innovative concepts described above.

What is claimed is:

1. A construction method for widening road, superhighway or railway tunnels, without interrupting a traffic flow, said method comprising a first stage in which a ground between a theoretical profile of a final widened tunnel and that of an original tunnel, is excavated, in steps, to widen and demolish said original tunnel, a second stage, in which a final lining, consisting of one or more arches comprising a plurality of prefabricated segments, is immediately placed in steps at a maximum distance of 2–3 meters from an excavation face, wherein said second stage comprises: transporting said segments to said face; applying a delayed setting epoxy resin on two ends of each segment to be placed and on a side of each segment that will come into contact with an arch of lining that has already been erected; raising and positioning said segments by a segment placing machine, placing the lowermost segments on each side of the tunnel first and then placing the segments in ascending order until the arch is completed with the placing of a key segment; placing a jack in the key segment under pressure to make said segments adhere to each other perfectly and to immediately produce a necessary pre-stressed effect to confine the ground around the widened tunnel, wherein before said first and second stage, the ground between said theoretical profile of said final widened tunnel and that of said original tunnel is reinforced and preconfinement operations are performed around a cavity of said final widened tunnel, wherein said method comprises a third stage, in which a foundation construction is made, appropriate to said final widened tunnel, and wherein during said first and second stages and, during reinforcement of the face and preconfinement of the cavity of said final widened tunnel, a traffic protecting steel shell is placed inside the profile of the original tunnel, above which all of the machinery employed in the execution of the said first two stages and in the, execution of the reinforcement of the face and preconfinement of the cavity of said final widened tunnel is operated and moved.

2. A construction method, according to claim 1, wherein a hollow space between the original tunnel lining and said traffic protecting steel shell is filled with a soundproofing and/or anti-shock material.

3. A construction method, according to claim 1, wherein said traffic protecting steel shell has a length equal to at least four times a diameter of said original tunnel to be widened.

4. A construction method, according to claim 1, wherein, from time to time, after said second stage, said steel shell is moved forwards for a length and said operational stages are repeated cyclically to provide said final widened tunnel.

5. A construction method, according to claim 1, wherein the operations for said reinforcement of the face and preconfinement of said final widened tunnel include a technique of horizontal jet grouting.

6. A construction method, according to claim 1, wherein the operations for said reinforcement of the face and preconfinement of said final widened tunnel include a technique of mechanical precutting.

7. A construction method, according to claim 1, wherein the operations for said reinforcement of the face and preconfinement of said final widened tunnel include a technique of reinforcement of the ground in advance by means of valved and grout injected fibre glass structural elements sub-horizontally inserted around the cavity.

* * * * *